United States Patent [19]

Shveikin et al.

[11] 4,212,670

[45] Jul. 15, 1980

[54] TITANIUM OXYCARBONITRIDE BASED HARD ALLOY

[76] Inventors: Gennady P. Shveikin, ulitsa Malysheva, 129, kv. 9; Vladislav D. Ljubimov, ulitsa Lunacharskogo, 182, kv. 122; Boris V. Mitrofanov, Sovetskaya ulitsa, 51, kv. 168; Vladimir A. Privalov, ulitsa Dobroljubova, 2, kv. 2, all of Sverdlovsk; Evgeny K. Plaxin, Kirovgradskaya ulitsa, 3, kv. 27, Kirovgrad Sverdlovskoi oblasti; Dmitry S. Elinson, ulitsa Shartashskaya, 10, kv. 12, Sverdlovsk; Stanislav I. Alyamovsky, ulitsa Lunacharskogo, 87, kv. 64, Sverdlovsk; Jury G. Zainulin, ulitsa Malysheva, 131, kv. 5, Sverdlovsk; Sergei P. Makarov, ulitsa Gazorezchikov, 8, kv. 1, Sverdlovsk, all of U.S.S.R.

[21] Appl. No.: 885,486

[22] Filed: Mar. 13, 1978

Related U.S. Application Data

[63] Continuation of Ser. No. 658,693, Feb. 17, 1976, abandoned.

[51] Int. Cl.[2] ..... C22C 1/05; C22C 29/00

[52] U.S. Cl. ..... 75/233; 75/237; 75/238

[58] Field of Search ..... 75/233, 237, 238, 205

[56] References Cited

U.S. PATENT DOCUMENTS

| | | | |
|---|---|---|---|
| 3,671,201 | 6/1972 | Bergna | 75/238 X |
| 3,741,733 | 6/1973 | Kieffer | 75/205 X |
| 3,971,656 | 7/1976 | Rudy | 75/238 X |

OTHER PUBLICATIONS

Kieffer et al., Mod. Dev. Powd. Met., vol. 5, 1971, pp. 201–214.

*Primary Examiner*—Richard E. Schafer
*Attorney, Agent, or Firm*—Lackenbach, Lilling & Siegel

[57] ABSTRACT

The proposed titanium carbonitride-base hard alloy contains in percent by weight:

nickel, from 9.5 to 49.0
molybdenum, from 2.5 to 20.5, the level of carbon not exceeding 0.6 percent by weight, and the titanium carbonitride $TiC_xN_y$ has the following component ratio:

x, from 0.45 to 0.55
y, from 0.41 to 0.55.

The alloy of the invention can be employed most advantageously for manufacturing cutting tools for the metalworking industry.

1 Claim, No Drawings

TITANIUM OXYCARBONITRIDE BASED HARD ALLOY

This is a continuation of application Ser. No. 658,693 filed Feb. 17, 1976, now abandoned.

The present invention relates to titanium carbonitride-base hard alloys.

The most advantageous application of the proposed alloy is for manufacturing cutting tools for the metal-working industry where tungsten carbide-base hard alloys which are both costly and in short supply are currently used.

A trend has recently appeared to dispense with tungsten as the base of hard alloys.

The most promising substitutes for tungsten as the base of hard alloys found so far are titanium carbides and nitrides as well as solid solutions involving both said compounds.

It is known in metallurgy to employ a titanium carbide-base alloy with a nickel-molybdenum binder which in terms of hardness, bending strength and steel-cutting characteristics is equivalent to the similar alloys on the basis of a solid solution of titanium carbide with tungsten carbide TiC-WC and tungsten carbide WC.

A solid solution of titanium carbides and nitrides (carbonitrides) of the general empirical formula $TiC_xN_y$ has been found to show an even greater promise as an alloy base, the $TiC_xN_y$-base alloys being superior in cutting ability to hard alloys based on titanium carbide TiC.

It is known in metallurgy to employ a titanium carbonitride-base alloy with a nickel-molybdenum binder of the following composition:

$$TiC_{0.4}N_{0.6}+11.5Ni+3.5Mo.$$

This alloy has a high bending strength, 125 mg/sq.mm., but an unsatisfactorily low hardness, 87 HRA.

It is likewise known in the art to employ a titanium carbonitride-base hard alloy with a nickel-molybdenum binder of the following composition:

$$TiC_{0.6}N_{0.4}+11.5Ni+3.5Mo.$$

The latter alloy is hard enough, 91 HRA, but has a low bending strength, 85 kg/sq.mm.

With said characteristics, the prior art alloys can be employed for cutting metals.

However, in terms of their mechanical properties said alloys are inferior to the other known alloys on the basis of a solid solution of titanium carbide with tungsten carbide TiC-WC or tungsten carbide WC with a cobalt binder, since nobody has so far been able to combine adequate hardness with satisfactory bending strength in the prior art alloys and thereby to raise their performance.

It is a cardinal object of the present invention to provide a hard alloy fit for cutting metals which would be equivalent and in some cases superior to the tungsten carbide-base hard alloys in erms of their performance.

It is a further, and no less important, object of the invention to provide a very hard alloy.

It is yet another object of the invention to provide a hard alloy with a superior bending strength.

These and other objects are attained in a titanium carbonitride-base hard alloy containing nickel and molybdenum, wherein, in accordance with the invention, the nickel and molybdenum levels are in the range from 9.5 to 49.5 percent by weight and from 2.5 to 20.5 percent by weight, respectively, with the level of carbon not exceeding 0.6 percent by weight, and the titanium carbonitride has the following ratio of the components:

x, from 0.45 to 0.55 y, from 0.41 to 0.55.

If the component ratio goes below the above lower limit or exceeds the above upper limit, the alloy either gains in hardness and loses in bending strength or gains in bending strength but loses in hardness, respectively, which adversely affects the cutting ability thereof as against the known hard alloys based on a solid solution of titanium carbide with tungsten carbide TiC-WC or tungsten carbide WC.

The titanium carbonitride component of the proposed hard alloy preferably contains from 0.01 to 3.5 percent oxygen by weight and has the following composition:

$TiC_xN_yO_z$, where z=from 0.003 to 0.14 and $x+y+z=1$.

The foregoing composition conduces to excellent hardness and bending strength of the alloy as well as to its satisfactorily high performance exceeding that of the known hard alloys based on tungsten carbide WC and on a solid solution of titanium carbide with tungsten carbide TiC-WC.

The proposed hard alloy offers additional advantages of low porosity, from 0.1 to 0.3%, a close-grained structure of the carbonitride phase and a uniform pattern of distribution of the metallic binder.

The invention will be further understood from the following description of several exemplary embodiments thereof.

EXAMPLE 1

In this example, the charge contained 15 percent nickel by weight, 5 percent molybdenum by weight and 80 percent titanium carbonitride $TiC_{0.5}N_{0.5}$ by weight containing 0.3 percent uncombined carbon by weight.

The charge was comminuted in an ethanol medium in a ball mill lined with a hard alloy to a grain size of from 0.5 to 1.5 microns. The comminuted mixture was dried, mixed with a 3-percent solution of synthetic rubber, again dried, granulated and molded as cutter bits.

Then the moldings were subjected to sintering in a vacuum batch-type furnace or a continuous furnace at a temperature of 1,500° C. for 40 minutes at a residual pressure of $5.10^{-1}$–$10^{-1}$ mm Hg.

The product alloy had a hardness of 92 HRA, a bending strength of 120 kg/sq.mm, a porosity of 0.2 percent and a close-grained uniform structure.

The cutters manufactured from the proposed alloy were proved experimentally to be 1.2 to 10 times as wear resistant as the known hard alloy based on tungsten carbide WC in finishing applications involving high-carbon and alloyed steels.

EXAMPLE 2

In this example, the charge contained 22.5 percent Ni by weight, 7.5 percent Mo by weight and 70 percent titanium carbonitride $TiC_{0.55}N_{0.44}O_{0.01}$ by weight containing 0.2 percent uncombined carbon by weight.

The procedure of alloy preparation duplicated that of Example 1.

The alloy was sintered at a temperature of 1,460° C. for 40 minutes at a residual pressure of $5.10^{-1}-10^{-1}$ mm Hg.

The product alloy had a hardness of 90 HRA, a bending strength of 156 kg/sq.mm, a porosity of 0.1 percent and a close-grained structure of the carbonitride phase.

The alloy earmarked for semi-finishing of steels was found to be 2 to 5 times as wear resistant as the known hard alloys on the basis of a solid solution of titanium carbide with tungsten carbide TiC-WC.

EXAMPLE 3

In this example, the charge contained 30 percent Ni by weight, 10 percent Mo by weight and 60 percent titanium carbonitride $TiC_{0.447}N_{0.55}O_{0.003}$ by weight containing 0.02 percent uncombined carbon by weight.

The procedure of alloy preparation duplicated that of Example 1.

The alloy was sintered at a temperature of 1,450° C. for 40 minutes at a residual pressure of $5.10^{-1}-10^{-1}$ mm Hg.

The product alloy had a hardness of 89 HRA, a bending strength of 182 kg/sq.mm, a porosity of 0.1 percent and a close-grained uniform structure. The alloy earmarked for roughing and intermittent cutting of steels was found to be a perfect substitute for the known alloys on the basis of tungsten carbide WC and a solid solution of titanium carbide with tungsten carbide TiC-WC, being superior in performance thereto.

EXAMPLE 4

In this example, the charge contained 9.5 percent Ni by weight, 2.5 percent Mo by weight and 88 percent titanium carbonitride $TiC_{0.5}N_{0.5}$ by weight containing 0.1 percent uncombined carbon by weight.

The procedure of alloy preparation duplicated that of Example 1.

The alloy was sintered at a temperature of 1,520° C. for 60 minutes at a residual pressure of $10^{-1}$ mm Hg.

The product hard alloy of hardness 93 HRA and bending strength 110 kg/sq.mm was earmarked for steel finishing.

EXAMPLE 5

In this example, the charge contained 49 percent Ni by weight, 4.9 percent Mo by weight and 46.1 percent titanium carbinitride $TiC_{0.51}N_{0.48}$ by weight containing 0.3 percent uncombined carbon by weight.

The procedure of alloy preparation duplicated that of Example 1.

The alloy was sintered in a vacuum furnace at a temperature of 1,390° C. for 30 minutes at a residual pressure of $5.10^{-1}$ mm Hg.

The product alloy of hardness 87 to 88 HRA and bending strength 200 to 220 kg/sq.mm was earmarked for manufacturing dies for hot and cold working of metals.

EXAMPLE 6

In this example, the charge contained 20.5 percent Ni by weight, 20.5 percent Mo by weight and 59 percent titanium carbonitride $TiC_{0.54}N_{0.45}O_{0.01}$ by weight containing 0.25 percent uncombined carbon by weight.

The procedure of alloy preparation duplicated that of Example 1.

The alloy was sintered at a temperature of 1,450° C. for 80 minutes at a residual pressure of $10^{-1}$ mm Hg.

The product alloy had a hardness of 88 to 89 HRA and a bending strength of 140 kg/sq.mm.

EXAMPLE 7

In this example, the charge contained 22.5 percent ni by weight, 7.5 percent Mo by weight and 70 percent titanium carboniride $TiC_{0.44}N_{0.42}O_{0.14}$ by weight containing 0.6 percent uncombined carbon by weight.

The alloy was prepared in a procedure duplicating that of Example 1.

The alloy was sintered at a temperature of 1.450° C. for 60 minutes at a residual pressure of $10^{-1}$ mm Hg.

The product alloy had a hardness of 92 HRA, a bending strength of 130 kg/sq.mm, a porosity of 0.2 percent and a close-grained uniform structure.

The hard alloy thus obtained showed high wear resistance in continuous and intermittent steel cutting.

The present invention can be embodied as follows.

A titanium carbonitride-base hard alloy according to the Subject of the Invention, wherein the titanium carbonitride component contains from 0.01 to 3.5 percent oxygen by weight and has the following composition:

$$TiC_xN_yO_z,$$

where z=from 0.003 to 0.14 and $x+y+z=1$.

What is claimed is:

1. A titanium carbonitride-base hard alloy with a nickel-molybdenum binder comprising, in percent by weight:

nickel: 9.5–49.0 molybdenum: 2.5–20.5 uncombined carbon: not greater than 0.6, and wherein the titanium carbonitride component has the formula $TiC_xN_yO_z$, and contains oxygen in amounts varying from 0.155 to 3.5 percent by weight, said titanium carbonitride constituents having the following ratios: x=0.45 to 0.55, y=0.41 to 0.55, z=0.003 to 0.14, with $x+y+z=1$; said alloy having a low porosity of from 0.1 to 0.3 percent.

* * * * *